US010406848B2

(12) United States Patent
Harris et al.

(10) Patent No.: US 10,406,848 B2
(45) Date of Patent: Sep. 10, 2019

(54) FOLDER WITH STAND

(71) Applicant: ACCO Brands Corporation, Lake Zurich, IL (US)

(72) Inventors: Richard H. Harris, Xenia, OH (US); Patrick B. Nolan, Royersford, PA (US); Noah E. Dingler, Phoenixville, PA (US); Laura E. Reasoner, Columbus, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 119 days.

(21) Appl. No.: 13/852,603

(22) Filed: Mar. 28, 2013

(65) Prior Publication Data

US 2014/0291977 A1 Oct. 2, 2014

(51) Int. Cl.

| | |
|---|---|
| ***B42F 7/06*** | (2006.01) |
| ***B42F 13/40*** | (2006.01) |
| ***B42D 3/12*** | (2006.01) |

(52) U.S. Cl.

CPC ..... *B42F 7/06* (2013.01); *B42D 3/126* (2013.01); *B42F 13/40* (2013.01); *B42F 13/402* (2013.01); *B42P 2241/12* (2013.01)

(58) Field of Classification Search

CPC ... B42D 1/00; B42D 5/00; B42D 3/00; B42D 7/00; B42D 3/126; A47B 23/00; B42F 13/00; B42F 7/04; B42F 13/40; B42F 13/402; B42P 2241/12

USPC .... 281/15.1, 20, 29, 33, 45; 402/73, 74, 76; 248/174, 150, 460

See application file for complete search history.

(56) References Cited

U.S. PATENT DOCUMENTS

| | | | | |
|---|---|---|---|---|
| 2,218,347 | A * | 10/1940 | St Louis | B42F 13/402 281/33 |
| 2,587,316 | A * | 2/1952 | Henry | A47B 23/044 248/459 |
| 2,979,343 | A * | 4/1961 | Cline et al. | 281/33 |
| 3,305,205 | A | 2/1967 | Frankl | |
| 4,015,863 | A * | 4/1977 | Holum | 281/33 |
| 4,377,271 | A * | 3/1983 | Smith | B42F 13/402 248/460 |
| 5,480,118 | A | 1/1996 | Cross | |
| 7,000,882 | B2 | 2/2006 | Snuffer et al. | |
| 2013/0048517 | A1* | 2/2013 | Mecchella | A45C 11/00 206/216 |

* cited by examiner

*Primary Examiner* — Justin V Lewis

(74) *Attorney, Agent, or Firm* — Fitch, Even, Tabin & Flannery LLP

(57) ABSTRACT

A folder including a folder body having a first panel and a second panel pivotally coupled together. The folder further includes a stand pivotally coupled to the first and second panels, the stand being movable to a support position wherein the stand is configured to support the folder body in a propped position.

31 Claims, 14 Drawing Sheets

FOLDER WITH STAND

The present invention is directed to a folder, and more particularly, to a folder with a stand that can support the folder in a propped position.

BACKGROUND

Folders, portfolios, pockets and the like can be used to store loose papers and other items. In some cases, it may be desired to prop the folder, portfolio or pocket in an upright position to provide improved visibility or display the contents. However, when using existing devices, a separate component must often be utilized to prop the device in its upright position.

SUMMARY

In one embodiment the present invention is a folder having a stand that is operable to prop the folder in an upright position. More particularly, in one embodiment the invention is a folder including a folder body having a first panel and a second panel pivotally coupled together. The folder further includes a stand pivotally coupled to the first and second panels, the stand being movable to a support position wherein the stand is configured to support the folder body in a propped position.

DETAILED DESCRIPTION

Figure 1:
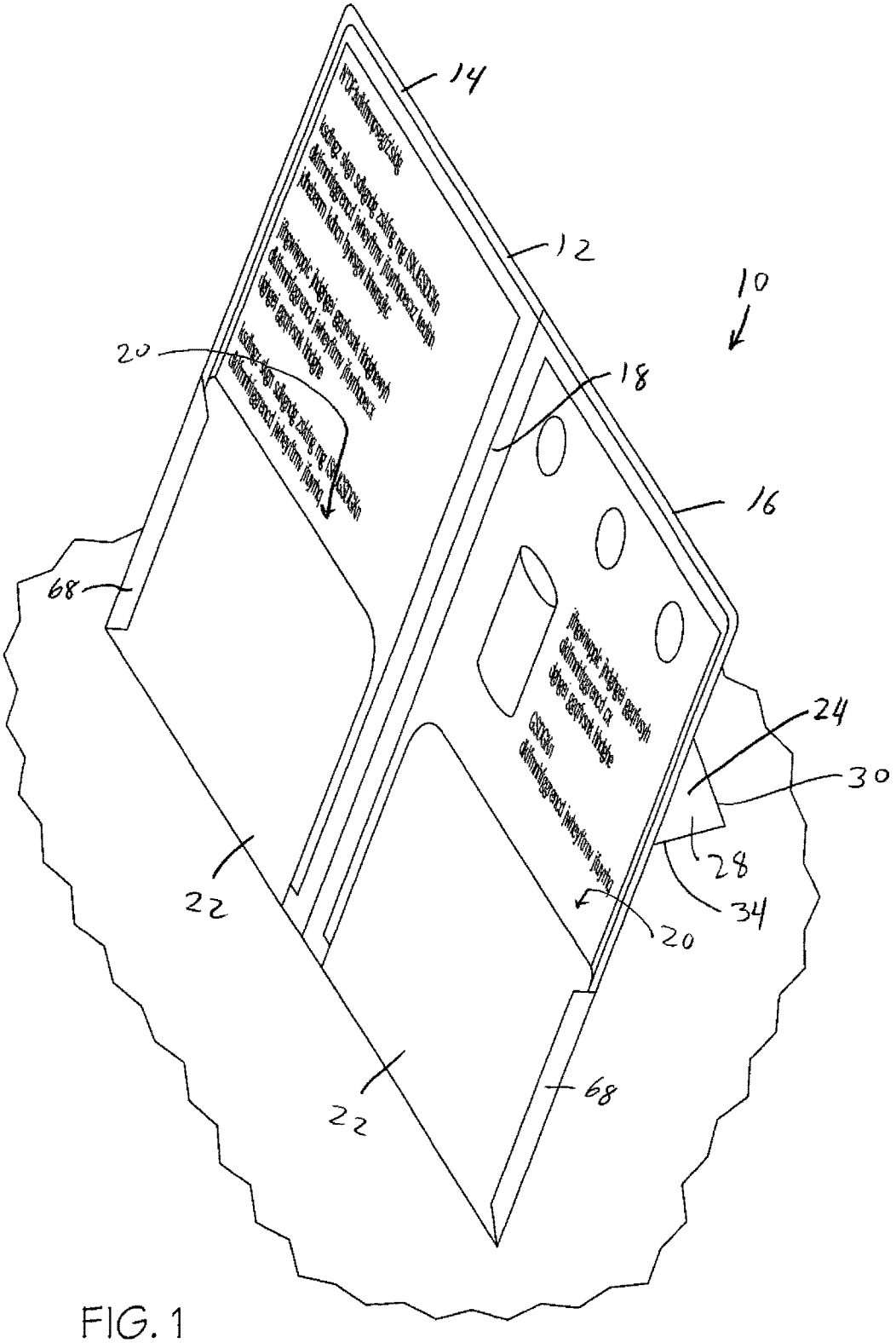
FIG. 1 is a front perspective view of one embodiment of the folder, shown in its propped position.

As shown in FIGS. 1-5, in one embodiment the present invention takes the form of a folder, portfolio, storage device, display device, pocket or the like, collectively termed a "folder" 10 herein. The folder 10 may include a folder body 12 having first 14 and second 16 opposed, generally rectangular panels that are pivotally coupled together along a spine or fold line 18. Each of the first 14 and second 16 panels may be generally flat and planar, and may include a pocket 20 positioned on its inner surface thereof and defined by a pocket panel 22. The folder 10 is moveable between a closed position (FIGS. 3 and 4), wherein the first 14 and second 16 panels are generally parallel and overlapping, blocking access to the pockets 20, and an open position (FIGS. 1 and 2) wherein the first 14 and second 16 panels are generally parallel and non-overlapping, providing access to the pockets 20.

Figure 2:
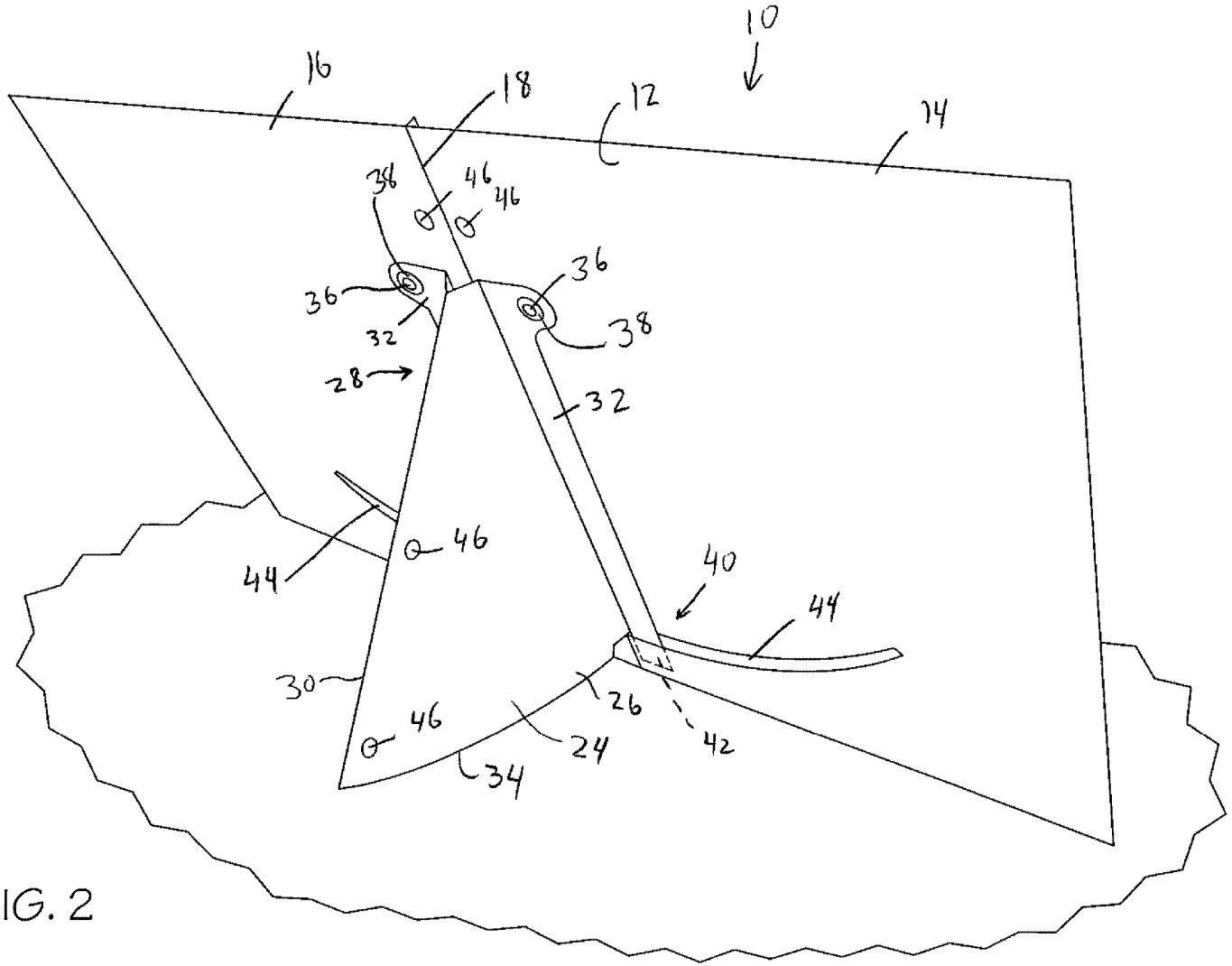
FIG. 2 is a rear perspective view of the folder of FIG. 1.
Figure 3:
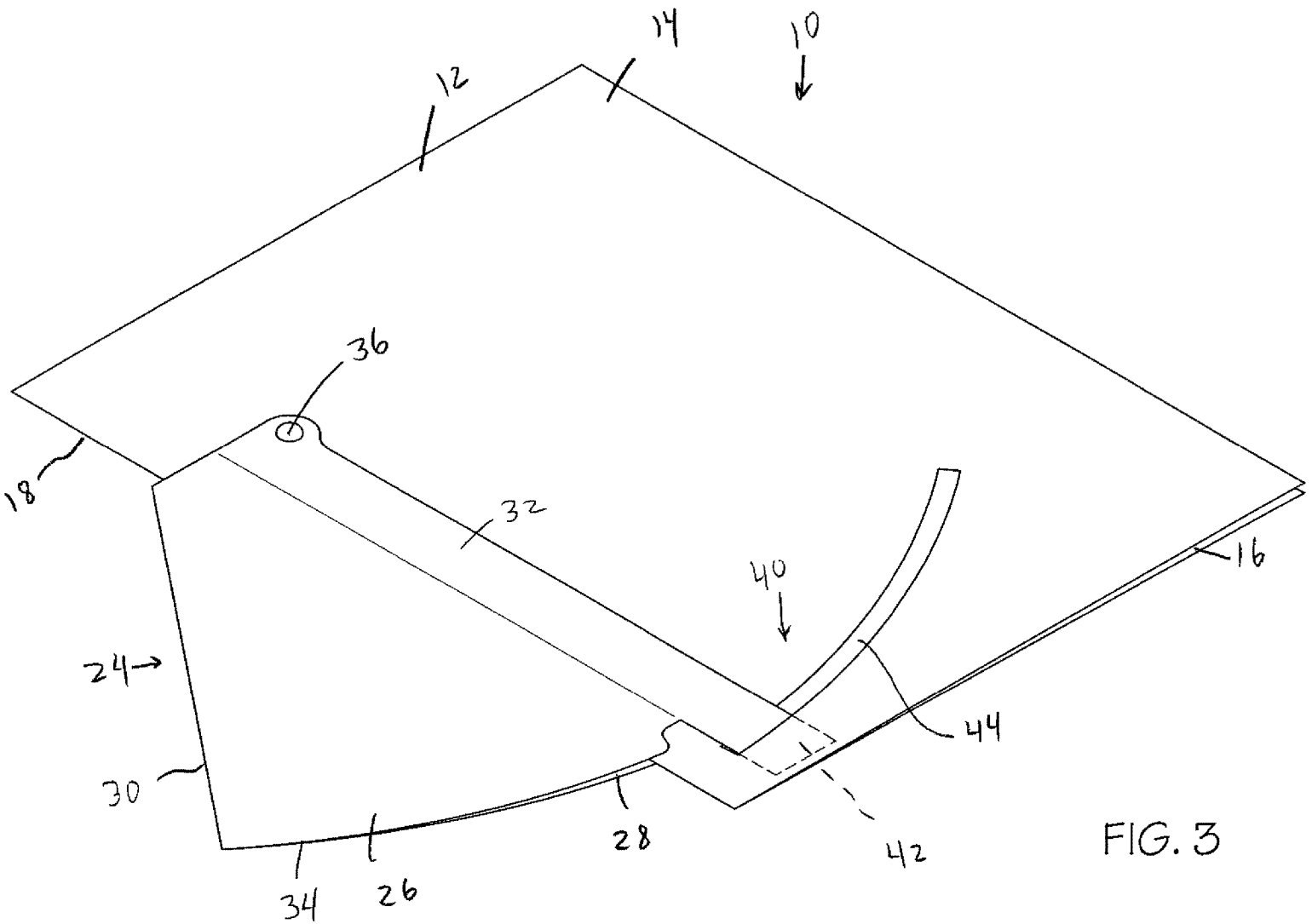
FIG. 3 is a rear perspective view of the folder of FIG. 1, with the folder in a closed position.
Figure 4:
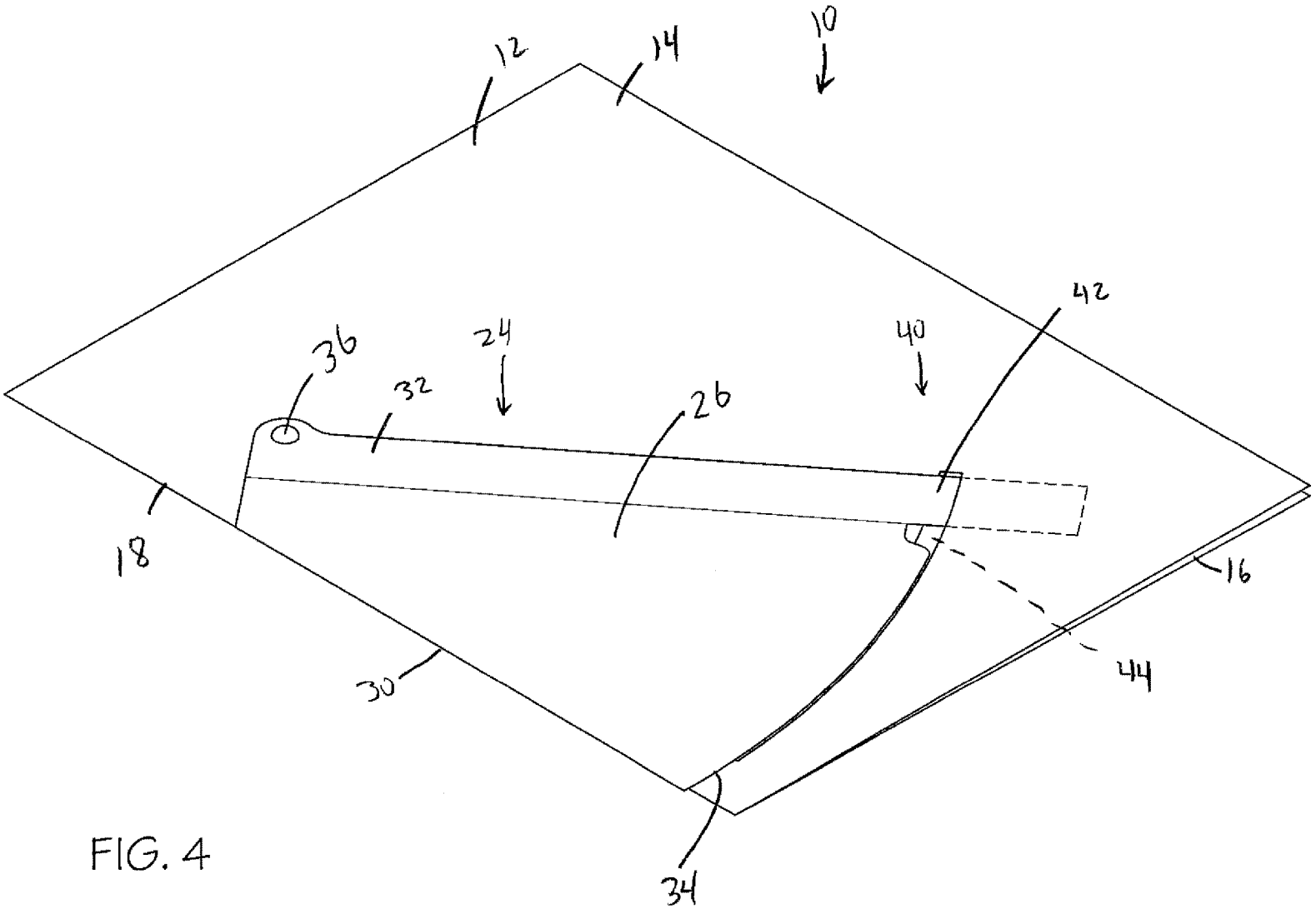
FIG. 4 is a rear perspective view of the folder of FIG. 3, with the stand in a collapsed position.

The folder 10 may further include a stand 24 pivotally coupled to the folder body 12. The stand 24 may include a first 26 and second 28 generally parallel, flat overlapping and sheet-like portions joined together about a stand fold line 30. Each of the first 26 and second 28 portions of the stand 24, and the stand 24 itself, may be generally triangular in side view, as shown in FIGS. 2-4. The base 34, or bottom-most portion of the stand 24, may be generally curved, as shown in the illustrated embodiment, but could also be generally straight or take other shapes and configurations. Each portion 26, 28 may include an ear flap 32 pivotally coupled to a main body of each portion 26, 28.

In the embodiment illustrated in FIGS. 1-5, the stand 24 is pivotally coupled to the folder body 12 at a pair of pivot points 36. In particular, in one embodiment a rivet 38 (FIG. 2) is passed through the ear flap 32 of the first portion 26 of the stand 24 and secured to the first panel 14, and another rivet 38 is passed through the ear flap 32 of the second portion 28 of the stand 24 and secured to the second panel 16. The pivot points 36 are aligned when the folder body 12 is closed (FIGS. 3 and 4) to define a pivot axis, perpendicular to the panels 14, 16 about which the stand 24 is pivotable. Of course, the stand 24 can be pivotally coupled to the folder body 12 by various other coupling devices besides rivets.

The stand 24/folder body 12 may also include a guide system 40 at the lower/bottom end of the stand 24/folder body 12 to guide pivotal movement of the stand 24 relative to the folder body 12. In particular, in the illustrated embodiment, each portion 26, 28 of the stand 24 includes a downwardly-extending tab 42. In one case each tab 42 may be entirely positioned on, and/or defined by, an ear flap 32. Each panel 14, 16 of the folder body 12 includes an opening 44, in the form of a generally arcuate slit in the illustrated embodiment, with the pivot points 36 at the center of the arcs. Each tab 42 is slidably/moveably received in an associated opening 44 to guide pivotal movement of the stand 24.

The stand 24 is pivotable/moveable between a support position and a collapsed position. As shown in FIG. 4, when the folder body 12 is in its closed position, the stand 24 can be moved to its collapsed position. When in the collapsed position, the folder body 12 is generally received between the first 26 and second 28 portions of the stand 24 such that the stand 24 closely conforms against, and generally overlaps with, the folder body 12. The first portion 26 of the stand 24 is positioned immediately adjacent to the first panel 14 of the folder body 12, and the second portion 28 of the stand 24 is positioned immediately adjacent to the second panel 16 of the folder body 12. The fold line 30 of the stand 24 is oriented generally parallel with, and positioned immediately adjacent to, the fold line 18 of the folder body 12.

In order to move the stand 24 to its support position, the stand 24 is pivoted about the pivot points 36, pivoting the stand 24 away from the folder body 12 until the stand 24 is in the support position shown in FIG. 3. As outlined above, as the stand 24 pivots about the pivot points 36, the interaction between the tabs 42/openings 44 smoothly guides the pivoting movement of the stand 24. When the stand 24 is in the support position, the stand portions 26, 28 are no longer located immediately adjacent to the panels 14, 16, and instead the stand portions 26, 28 are parallel and positioned immediately adjacent to each other. The stand 24 is generally aligned with the fold line 18 of the folder body 12 when the stand is in its support position. The fold line 30 of the stand 24 forms an angle (in one embodiment an angle of between about 15° and about 75°) relative to the fold line 18 of the folder body 12.

When the stand 24 is positioned in its support position, the folder body 12 can be moved to its open position, as shown in FIGS. 1 and 2. When the folder body 12 is in the open position, each ear flap 32 remains pressed against and parallel with the associated folder panel 14, 16, while the remainder of the stand portions 26, 28 move to a position oriented generally perpendicular to the associated folder panel 14, 16. Alternately, the stand 24 can be pivoted to its support position after, or as, the folder body 12 is opened. In any case, when the folder body 12 is in the open position and the stand 24 is in its support position, the folder 10 can be considered to be in a propped position wherein the folder 10 can remain stably positioned in the open position, and can be stably positioned on a horizontal surface by itself without any other supporting structures. In particular, the bottom edges of the first 14 and second 16 panels extend outwardly from and perpendicular to the bottom edges 34 of the support 24. In this manner, the bottom edges provide a stable platform such that the folder 10 is stably positioned in its open position.

When the folder 10 is in the propped position, the first 14 and second 16 panels may be generally coplanar and form a variety of angles with respect to the horizontal surface on which the stand 10 is supported such as, for example, between about 15° and about 75° in one case. In this manner, when the folder 10 is in its propped position, a user can view/display the contents of the pockets 20 or otherwise see inside the folder 10 without requiring a separate device to prop the folder 10 up/open. In addition, when the folder 10 is moved to its closed position, the stand 24 can be moved to its collapsed position and therefore add no, or, very little, shape/structure protruding outwardly from the basic footprint of the folder body 12, as shown in FIG. 4.

The stand 24 also does not interfere with normal operation of the folder 10. In particular, the folder body 12 can move between its open and closed position, and contents placed into and/or removed from the pockets 20. The stand 24 can be maintained in its closed position, and the stand portions 26, 28 pivot about the stand fold line 30 as the folder body 12 is opened or closed. In addition, in some cases the folder body 12 has a set of holes 46 formed therethrough to enable the folder 10 to be secured to a binding mechanism, such as a three ring binding mechanism. In this case, the stand 24 can also include holes 46 formed therethrough (see FIGS. 2, 6, 10 and 11), that are aligned with the holes on the folder body 12 when the stand 24 is in its collapsed position.

FIGS. 6-11 illustrate an alternate embodiment of the folder 10. In this case, with reference to FIG. 8, the stand 24 includes first 26 and second 28 portions separated by a stand fold line 30, and includes the ear flaps 32 and lower tabs 42 similar to the tabs 42 outlined above in the embodiment of FIGS. 1-5. In this case, however, the stand 24 may also include a pair of slits 48 positioned at the upper end of the stand 24 positioned between each ear flap 32 and the body of the associated stand portion 26, 28. Each slit 48 defines an upper tab 50 generally aligned with the associated ear flap 32/lower tab 42.

Figure 6:
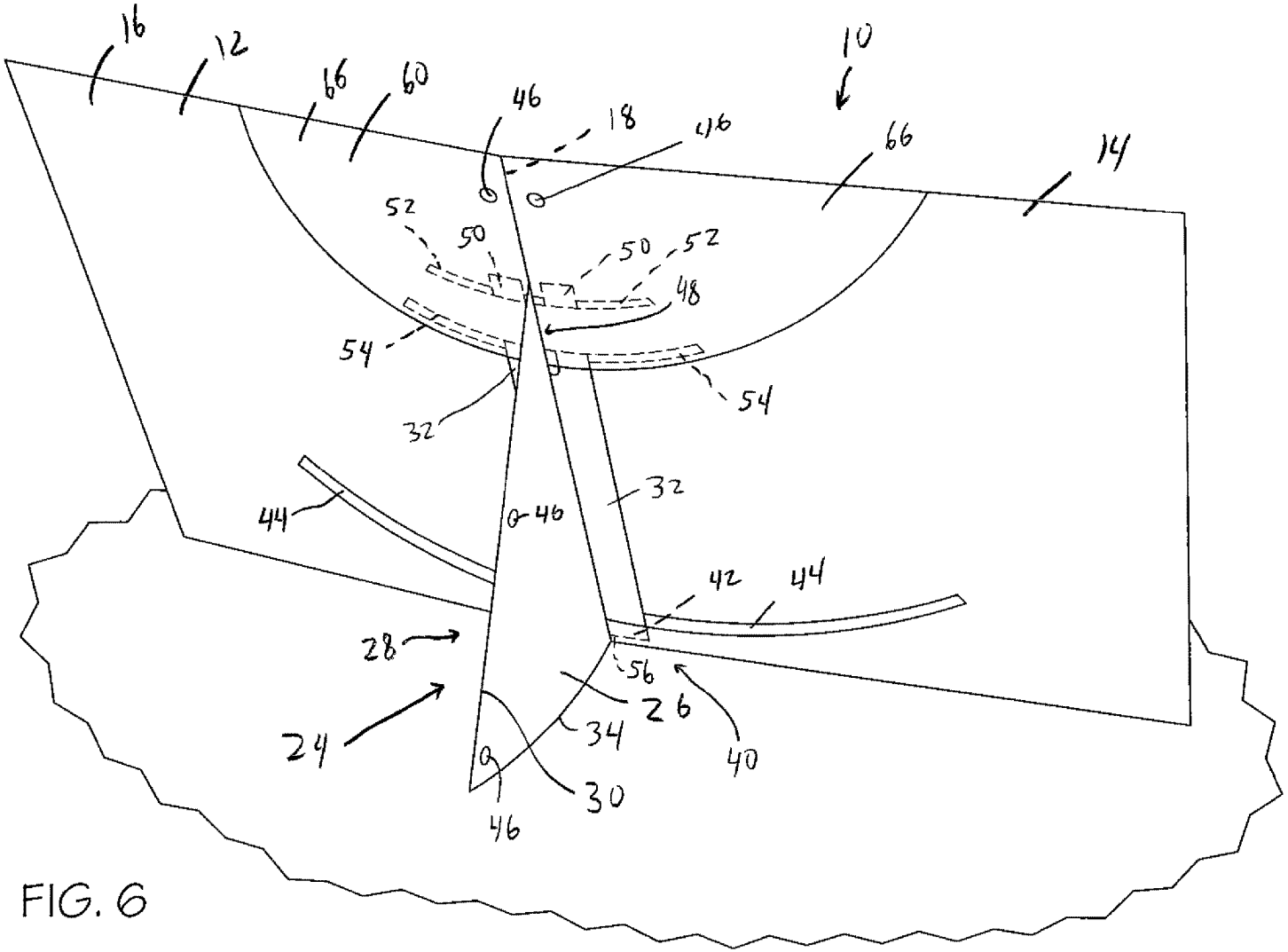
FIG. 6 is a rear perspective view of another embodiment of the folder, shown in its propped position.
Figure 7:
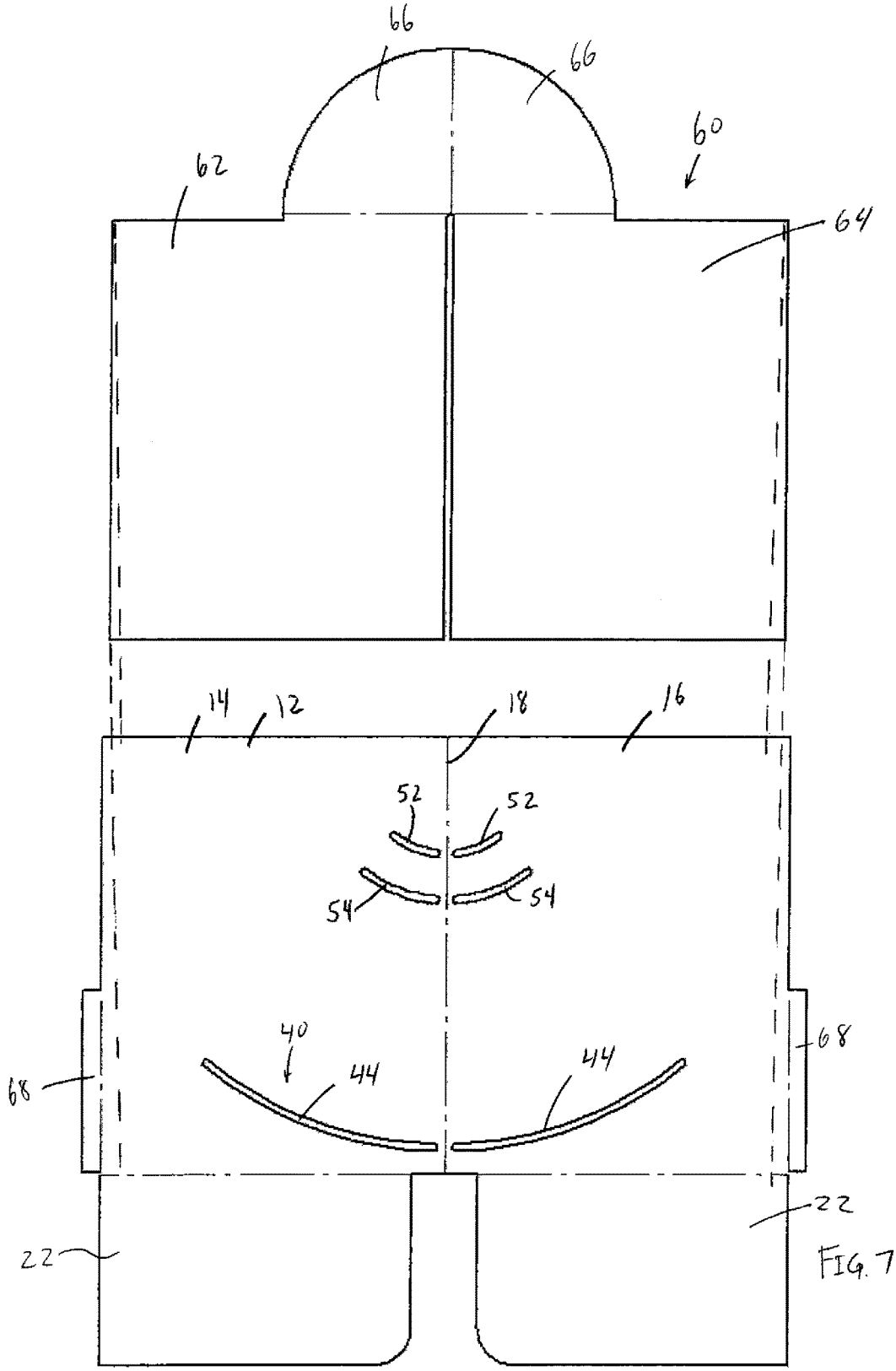
FIG. 7 is a front view of the folder body of FIG. 6, with the protective component exploded from the folder body the folder body partially disassembled.

As shown in FIGS. 6 and 7, each panel 14, 16 of the folder body 12 includes a lower opening/slot 44 the same as or similar to the opening 44 in the embodiment outlined above. However, each panel 14, 16 may also include an upper opening 52 and middle opening 54 positioned adjacent each other and spaced relatively close together. In the illustrated embodiment, the upper 52 and middle 54 opening each take the form of a generally arcuate slit positioned adjacent the fold line 18 of the folder body 12. Each upper 52 and associated middle slit 54 may have the same center of curvature as each other and/or the lower slit 44.

Figure 8:
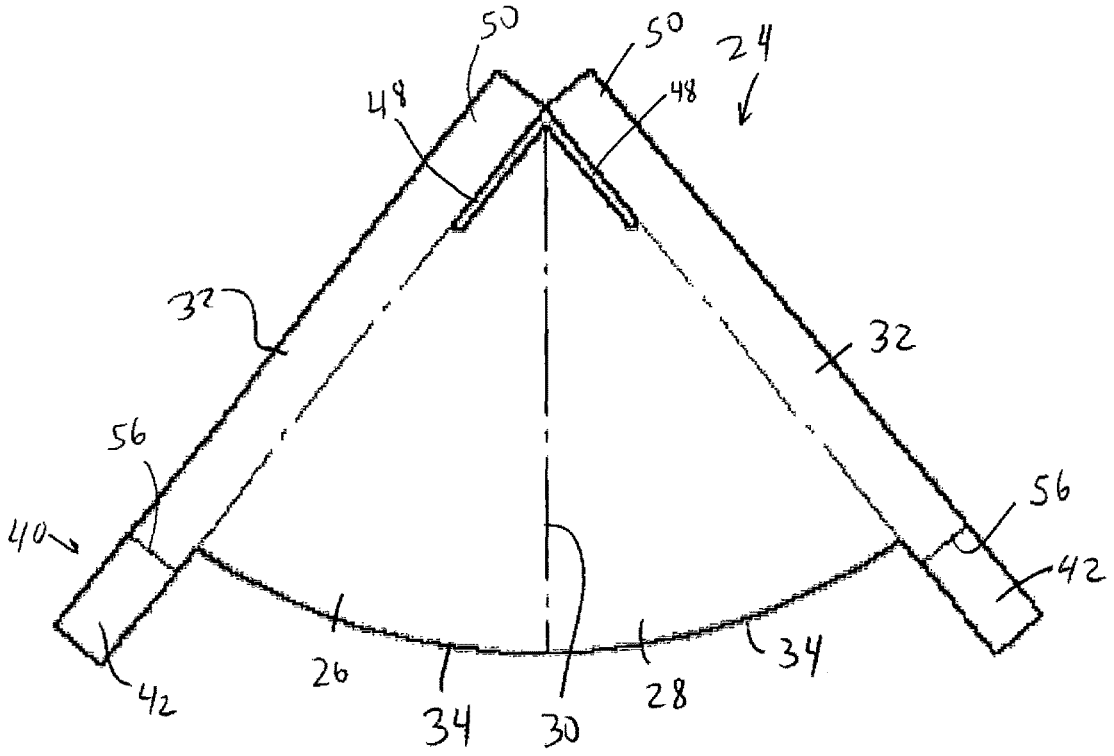
FIG. 8 is a front view of the stand of the folder of FIG. 6.
Figure 9:
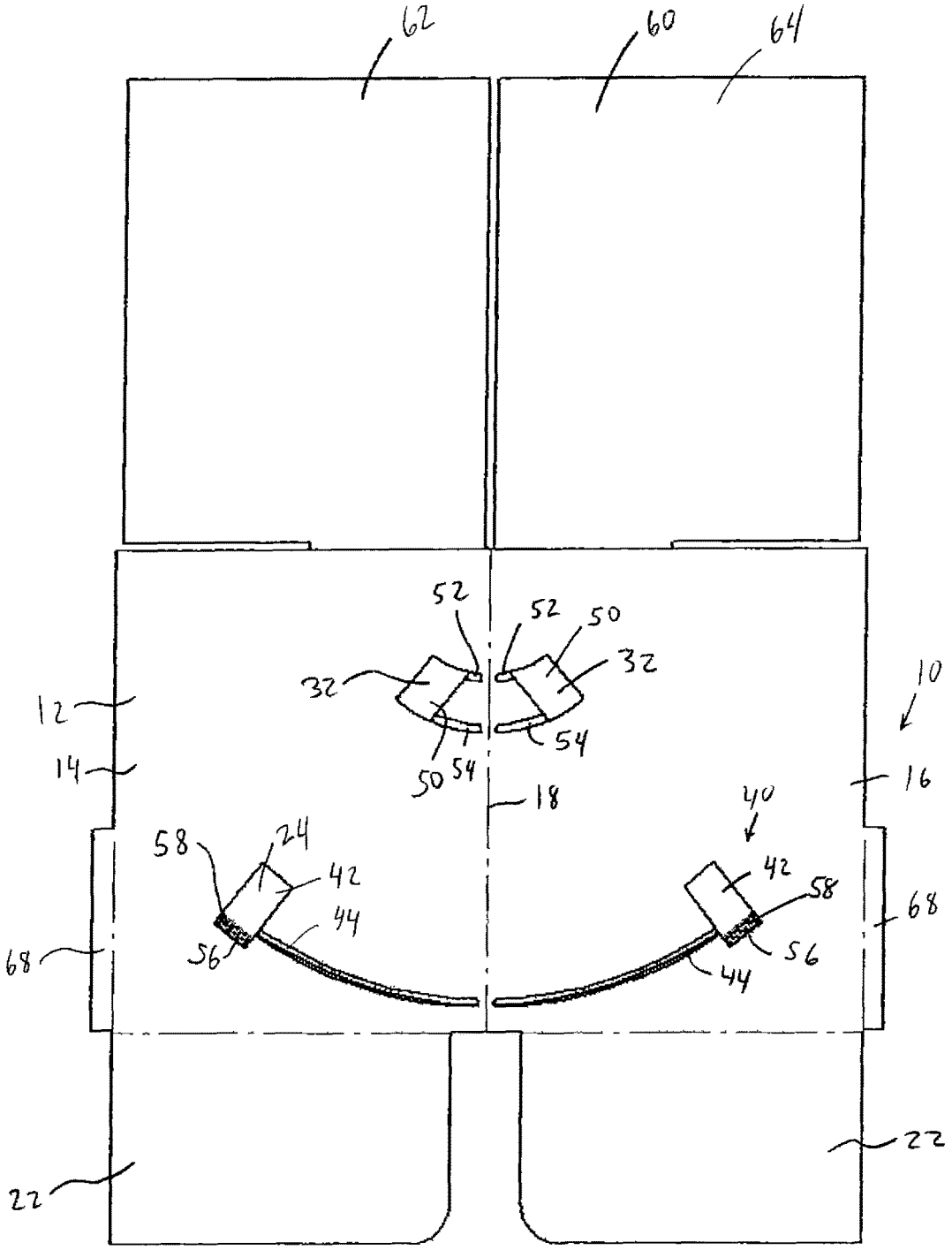
FIG. 9 is a front view of the folder body of FIG. 7, with the stand of FIG. 8 mounted thereto.
Figure 10:
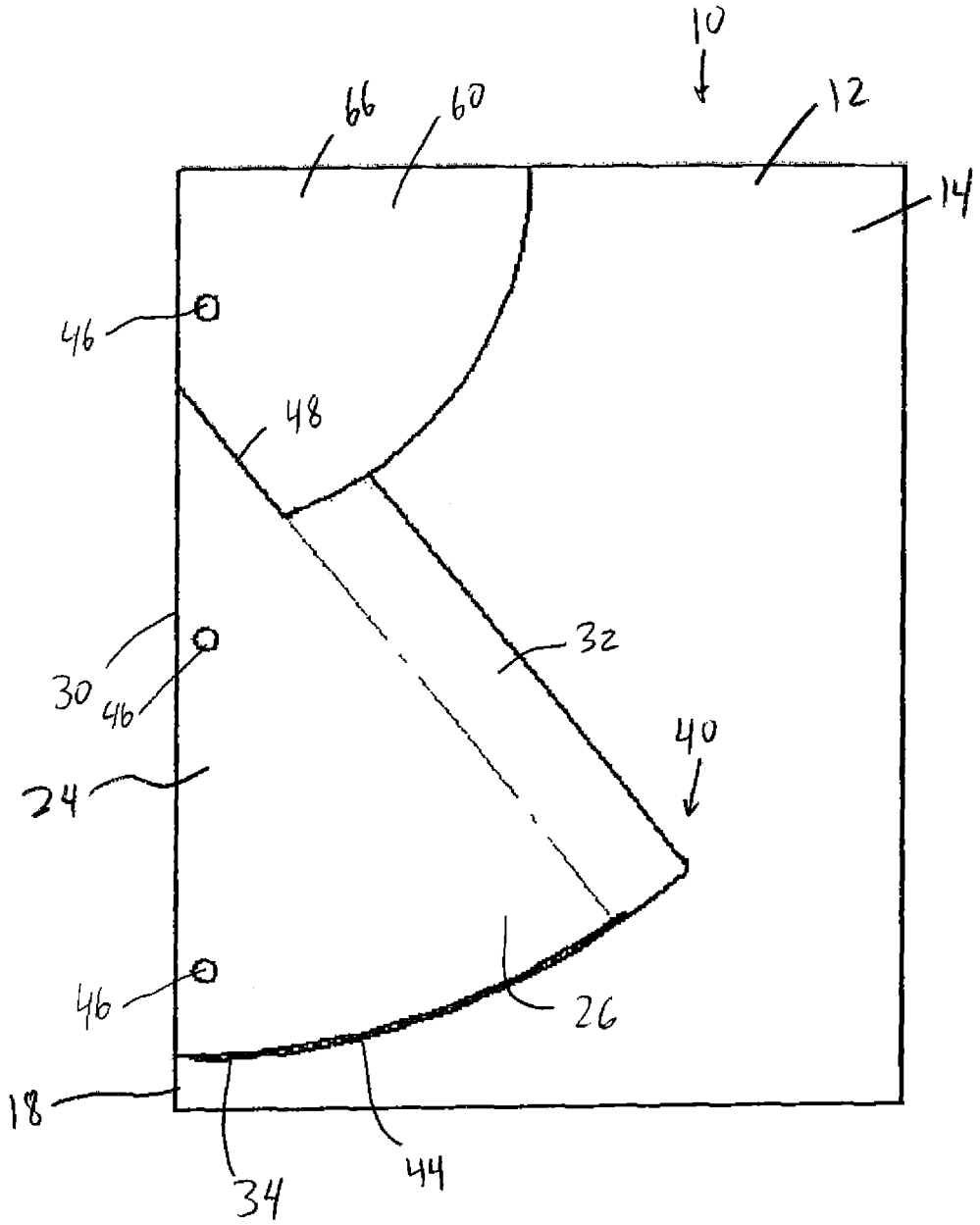
FIG. 10 is a side view of the folder of FIG. 6, with the folder body in its closed position and the stand in its collapsed position.
Figure 11:
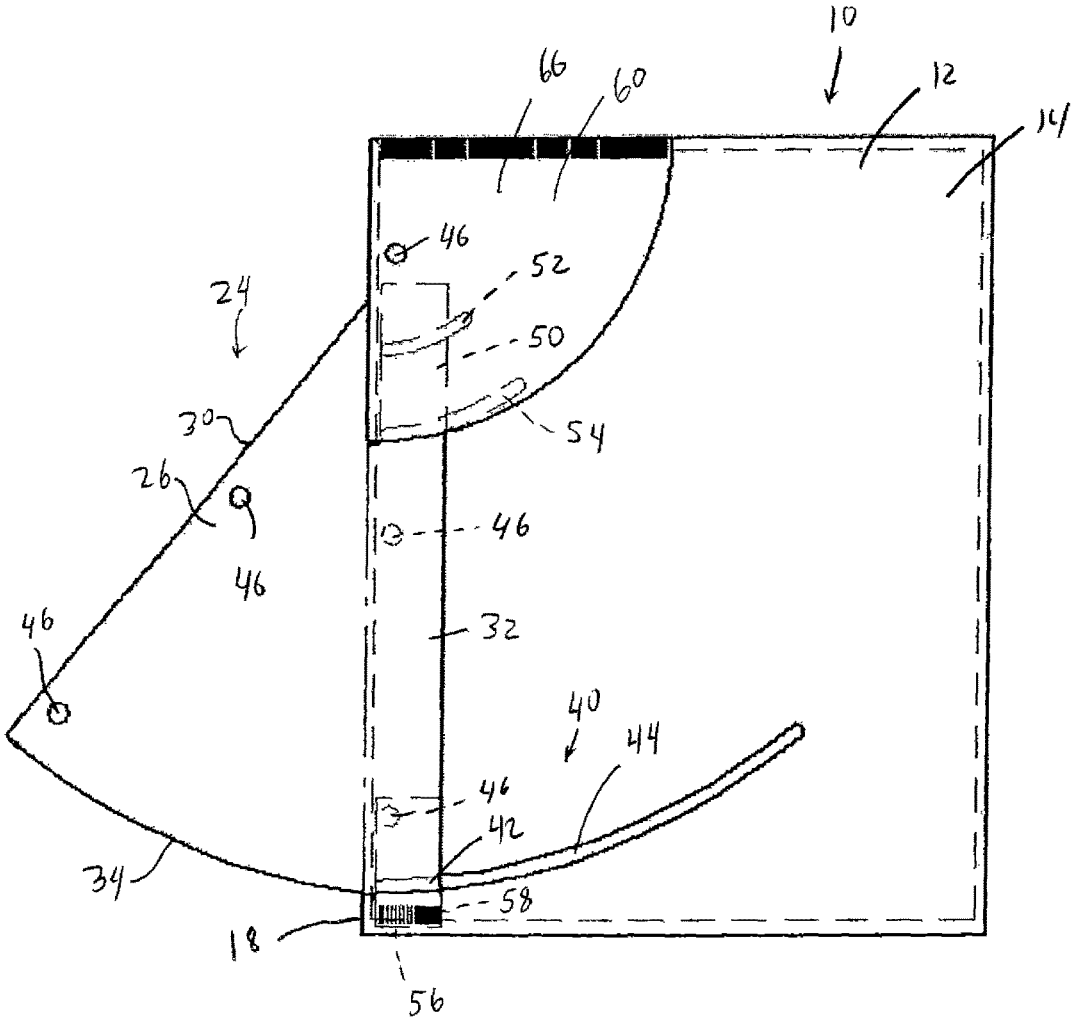
FIG. 11 is a side view of the folder of FIG. 10, with the stand in its support position.

In order to couple the stand 24 of FIG. 8 to the folder body 12 of FIG. 7, the stand 24 is positioned adjacent the outer surface of the folder body 12 and the lower tabs 42 are fit through the lower openings 44, similar to the embodiment of FIGS. 1-5. As shown in FIG. 9, in order to secure the stand 24 in place, the portion of each lower tab 42 protruding through the associated lower opening 44 can be folded back about itself until it extends generally upwardly, and is positioned on an inner surface of the associated panel 14, 16 above the lower slit 44. Each lower tab 42 may then be welded or otherwise secured to itself adjacent to the fold line 56 where the lower tab 42 is folded about itself, indicated by weld area 58 of FIG. 9. The fold line 56 of each lower tab 42 is also shown in FIG. 8. It should also be noted that this method of securing the lower tabs 44 can also be used in the embodiments of FIGS. 1-5.

Each upper tab 50 is then threaded into the associated middle opening 54 and out of the associated upper opening 52 (see FIGS. 6 and 9). If desired, each upper tab 50 may be folded about itself and/or welded or otherwise secured to itself as outlined above with respect to the lower tabs 44, to secure each upper tab 50 in place. In this manner, the tabs 44, 50 can be secured in place to ensure that the stand 24 is not easily removed and remains in place during use of the folder 10.

The stand 24 of FIGS. 6-11 can then be pivoted between its collapsed position (FIG. 10) and its support position (FIGS. 6 and 11) so that the folder 10 can be maintained in its propped position. The functionality of the embodiment of FIGS. 6-11 is similar to that of the embodiment of FIGS. 1-5, except that rather than having a single mechanically defined pivot/connection point, the stand 24 is pivotally secured in place and guided in its movement by nature of the tabs 42, 50 and openings 44, 52, 54.

If desired, the folder 10 may include a protective component 60 positioned on an inner and/or outer surface of the folder body 12. In particular, with reference to FIG. 7, the protective component 60 includes a pair of inner panels 62, 64, each having an extension portion 66 thereof. Each inner panel 62, 64 can be about the same size and shape as an associated first 14 and second 16 panel of the folder body 12, and positioned thereover to cover the openings 44, 52, 54 and tabs 44, 50 protruding therethrough to provide a finished inner surface and avoid components stored in the pockets 20 from being snagged on the openings 44, 52, 54 and tabs 42, 50. The protective component 60 can be secured to the associated first 14 and second 16 panels by welds about the perimeter thereof. The pocket flaps 22 of FIG. 7 are then folded upwardly/inwardly over the protective component 60, and the side flaps 68 are then folded upwardly/inwardly over the pocket flaps 22 and secured in place.

Figure 5:
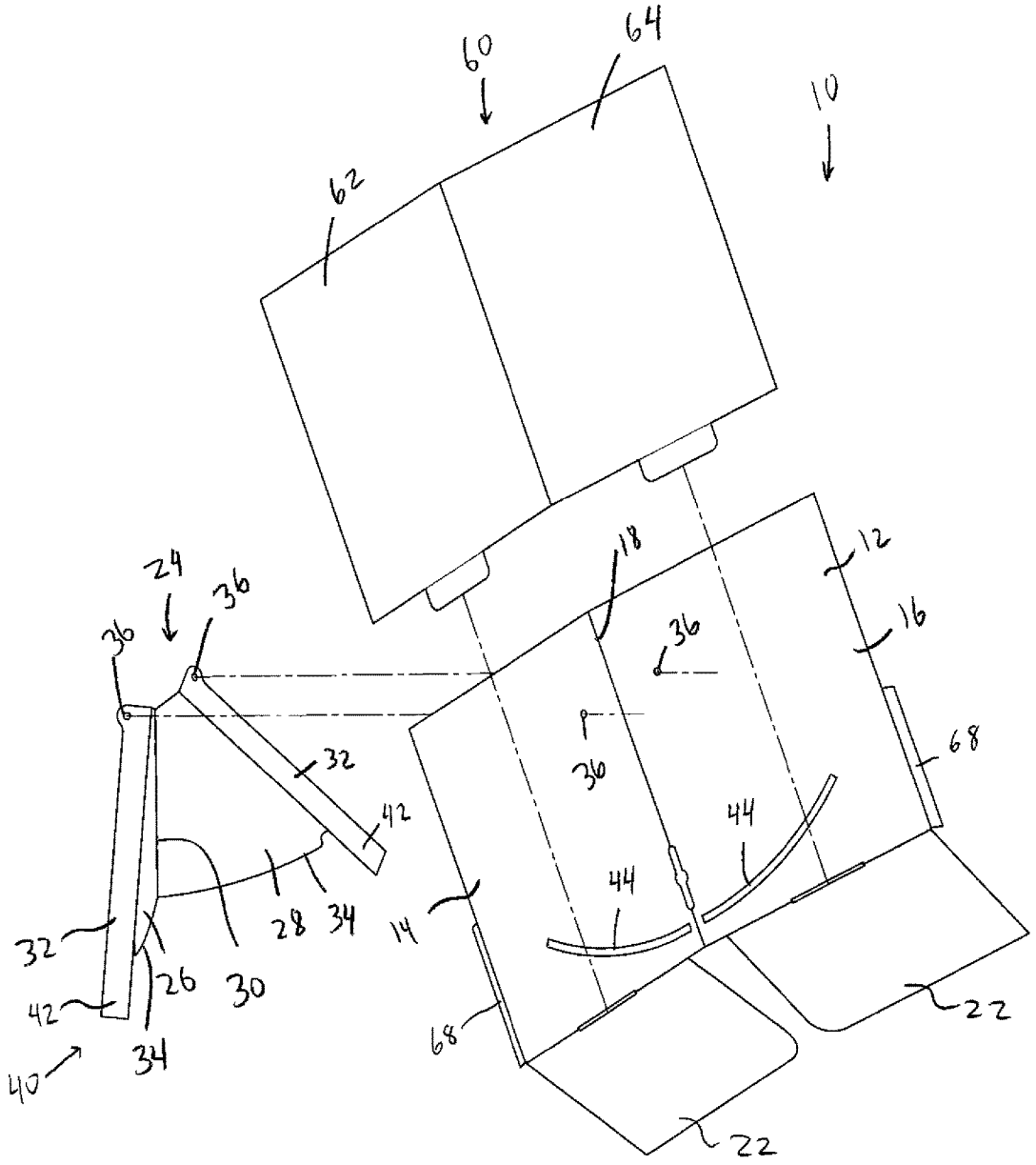
FIG. 5 is an exploded front perspective view of the folder of FIG. 1.

The extension portions 66 of the protective component 60 can be folded about the top edge of the folder body 12 and secured to an outer surface thereof, as shown in FIGS. 6 and 10-12. In the illustrated embodiment, the extension portions 66 cover the upper tabs 50 and upper 52 and middle openings 54 to further provide a finished appearance to the folder 12, on its outer surface. In addition, the slits 48 of the stand 24 may receive portions of the extension portions 66 therein. This arrangement enables the extension portions 66 to cover the upper 52 and middle 54 openings without interfering with the pivotal movement of the stand 24. As shown in FIG. 5, the embodiment of FIGS. 1-5 may also utilize a protective component 60 (which may lack the extension portions 66) positioned on the inner surface of the folder body 12 to protect/cover the slits 44 and/or tabs 42.

Figure 12:
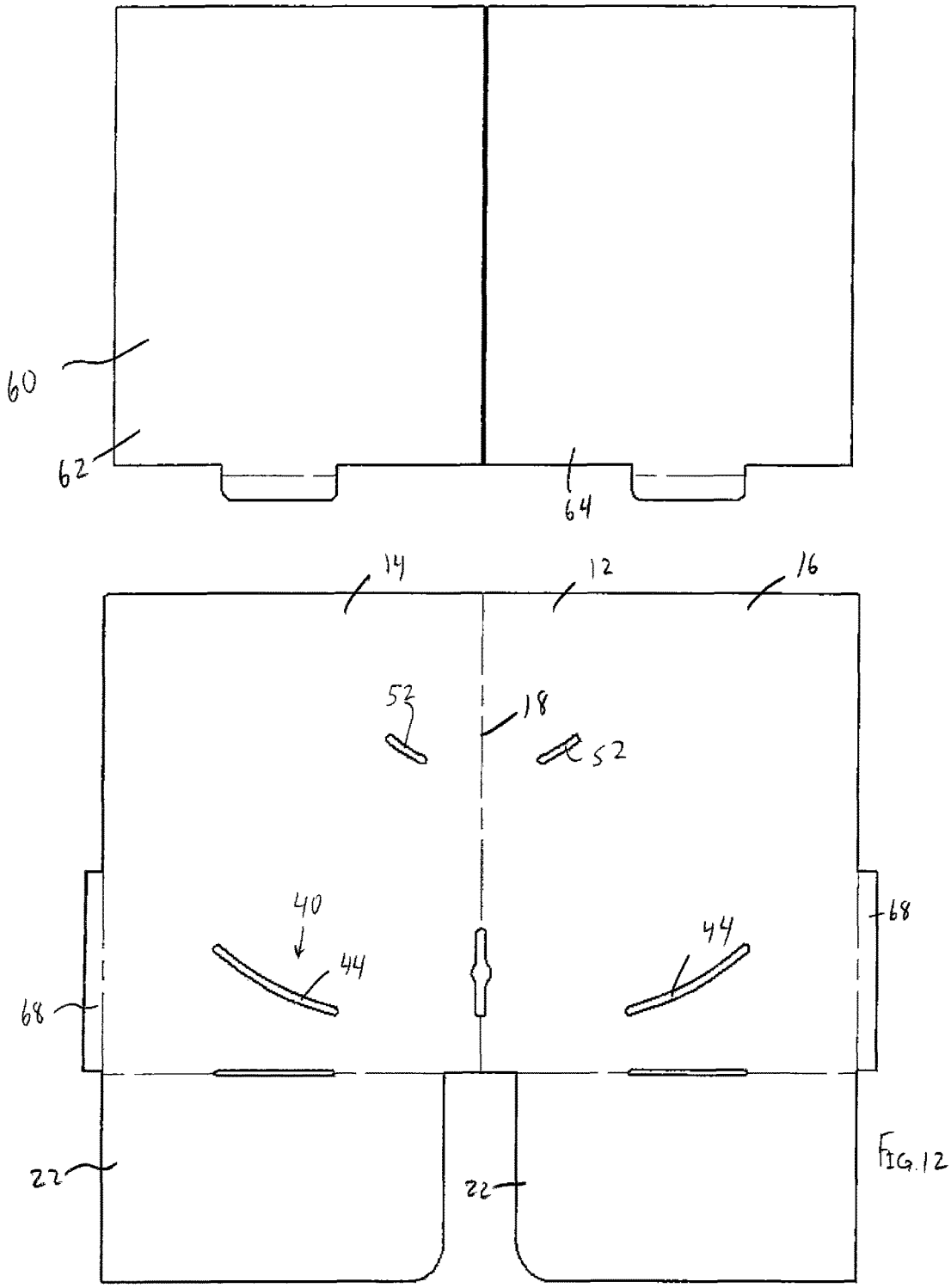
FIG. 12 is a front view of a folder body and protective component of another embodiment of the folder.
Figure 13:
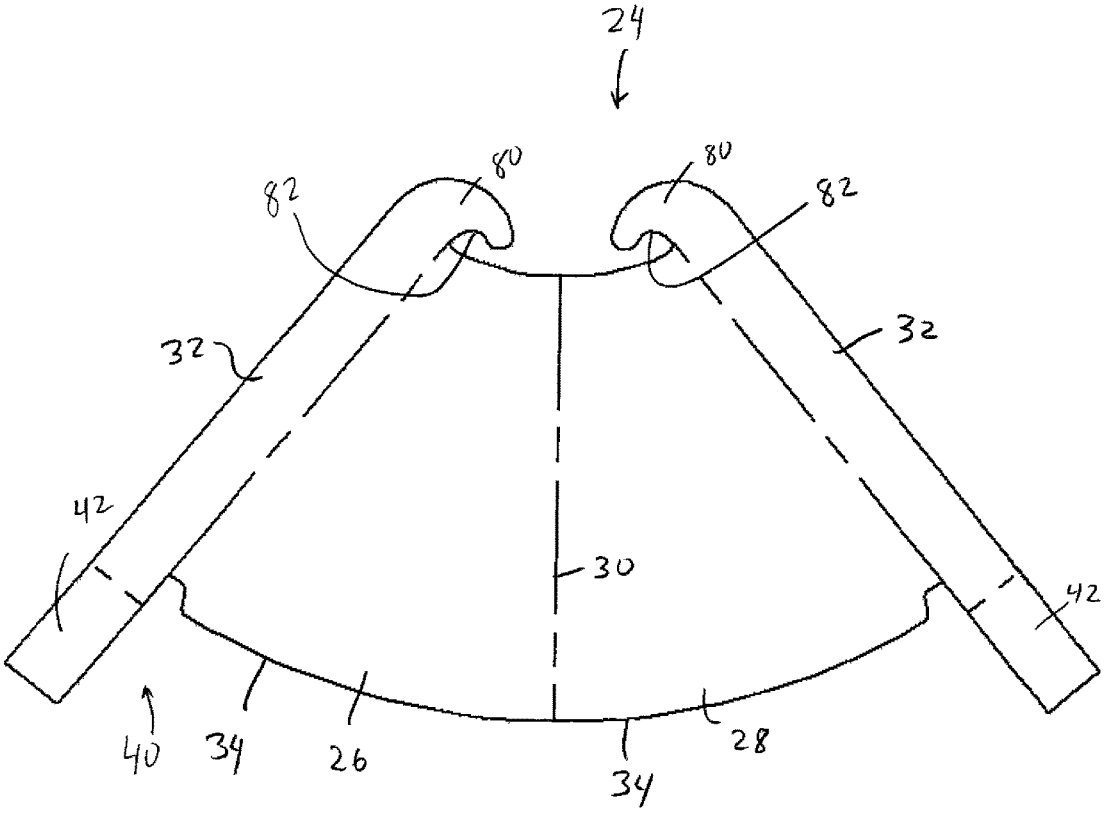
FIG. 13 is a front view of another embodiment of a stand.
Figure 14:
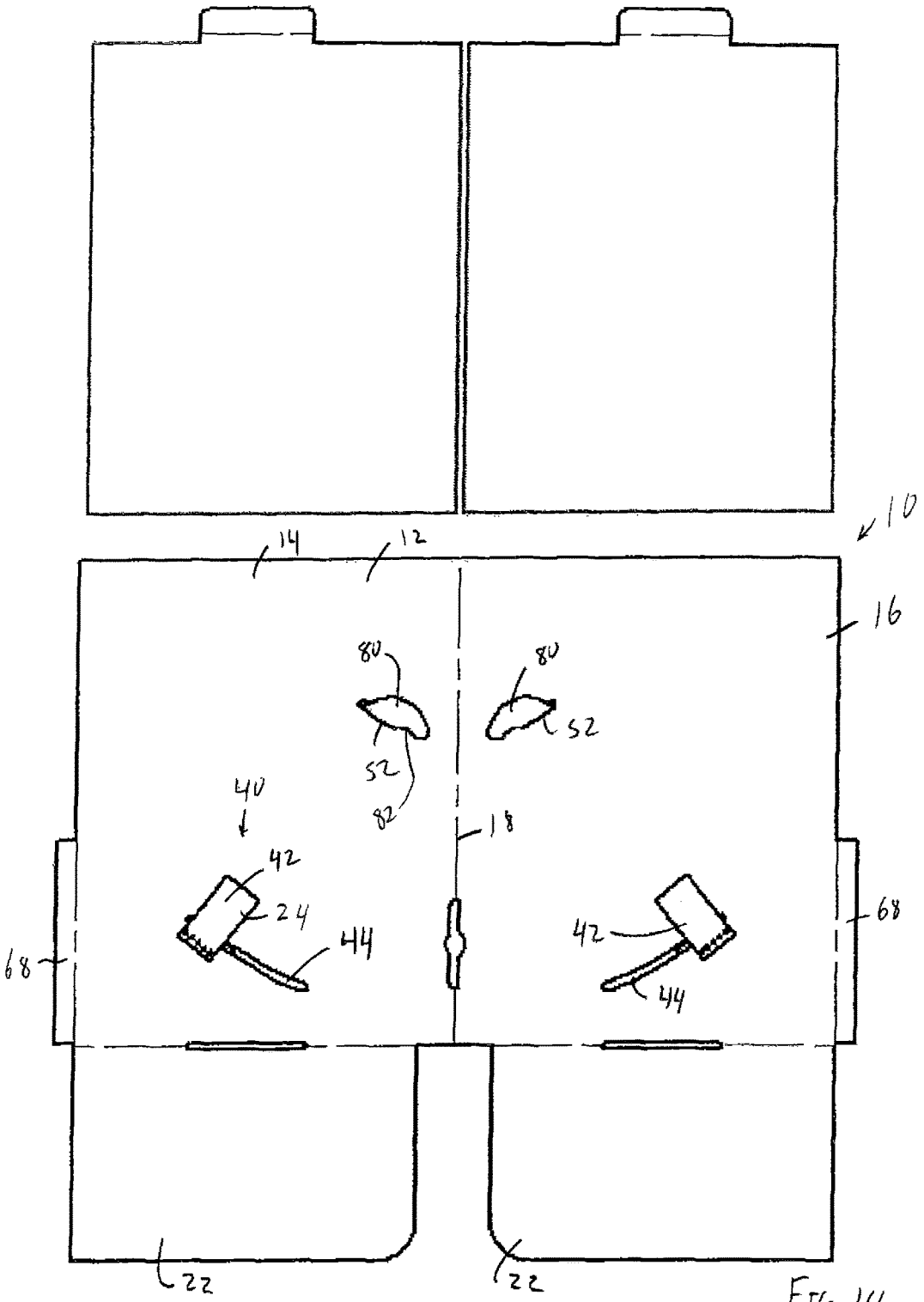
FIG. 14 is a front view of the folder body of FIG. 12, with the stand of FIG. 13 mounted thereto.

FIGS. 12-14 illustrate another embodiment of the invention. As shown in FIG. 12, the folder body 12 may include the lower openings 44 and upper openings 52 in the same or similar manner as the embodiment of FIGS. 6-11, but may lack the middle opening 54. As shown in FIG. 13, the stand 24 may include a set of upper tabs 80 that have tips that are curved toward the stand fold line 30 (in a somewhat "hook" or inverted "J" shape) with a curved lower edge 82. As shown in FIG. 14, the stand 24 of FIG. 13 can be coupled to the folder body 12 of FIG. 12 by passing the upper tabs 80 of the stand 24 through the upper openings 52 of the folder body 12. The curved or hook-like nature of the tips 80 ensures that the tips 80 remain in place in the upper openings 52 so that the stand 24 is secured coupled to the folder body 12. The curved lower edges 82 help to guide and ensure smooth pivoting of the stand 24 between its support position and its collapsed position. The lower tabs 42 can be passed through the lower openings 44 and, if desired, secured in place as outlined above.

It should be understood that the embodiments shown herein illustrate only three particular manners in which the stand 24 can be pivotally coupled to the folder body 12, and the stand 24 can be pivotally secured to the folder body 12, and its pivoting motion guided, by any of a wide variety of other devices and structures.

Having described the invention in detail and by reference to the various embodiments, it should be understood that modifications and variations thereof are possible without departing from the scope of the claims of the present application.

What is claimed is:

1. A folder comprising:

a folder body including a first panel and a second panel pivotally coupled to said first panel, wherein said first panel includes an opening; and a stand pivotally coupled to said first and second panels and positioned on a first side of said folder body, said stand being movable to a support position wherein said stand is configured to support said folder body in a propped position, and wherein said stand is pivotally coupled to each panel at an associated pivot point thereof defining a pivot axis positioned within and extending perpendicular to each associated panel, wherein the stand is made of a separate piece of material or materials than said folder body, and wherein said stand includes a tab received in said opening of said first panel; and a protective component positioned on a second side of said folder body, wherein at least part of said protective component covers the opening of said first panel, and wherein said protective component is directly coupled to said first panel.

2. The folder of claim 1 wherein said stand is configured to be oriented perpendicular to said first and second panels when said stand is in said support position.

3. The folder of claim 1 wherein said stand is pivotable between said support position and a collapsed position wherein said stand is not configured to support said first and second panels in said propped position.

4. The folder of claim 3 wherein said stand conforms against said folder body when said stand is in said collapsed position.

5. The folder of claim 1 wherein said folder body is movable to an open position wherein said first and second panels are parallel and non-overlapping, and wherein said stand is movable to said support position when said folder body is in said open position.

6. The folder of claim 1 wherein said folder body is in an open position wherein said first and second panels are parallel and non-overlapping, and wherein said stand is in said support position and is oriented perpendicular to said first and second panels, and wherein said folder is stably positioned on a horizontal surface by itself without any other supporting structure.

7. The folder of claim 1 wherein said first and second panels are pivotally coupled along a fold line, and wherein said stand is flat and planar and aligned with said fold line when in said support position.

8. The folder of claim 1 wherein said folder body is movable to a closed position wherein said first and second panels are parallel and overlapping, and wherein said stand is movable to a collapsed position wherein said stand overlaps with said folder body when said folder body is in said closed position.

9. The folder of claim 8 wherein said stand includes a first portion and a second portion separated by a fold line, and wherein said first portion is positioned immediately adjacent to said first panel when said folder body is in said closed position and said stand is in said collapsed position, wherein said second portion is positioned immediately adjacent to said second panel when said folder body is in said closed position and said stand is in said collapsed position.

10. The folder of claim 9 wherein said folder body is movable to an open position wherein said first and second panels are parallel and non-overlapping, and wherein said stand is movable to said support position when said folder body is in said open position, and wherein when said stand is in said open position said first and second portions of said stand are oriented parallel to each other and positioned immediately adjacent each other and oriented perpendicular to said first and second panels and oriented parallel to said fold line.

11. The folder of claim 1 wherein said stand is separately directly pivotally coupled to each of said first and second panels via a first pivot point of the first panel and a second pivot point of the second panel, wherein the first pivot point is spaced away from an outer perimeter of the first panel and the second pivot point is spaced away from an outer perimeter of the second panel.

12. The folder of claim 1 wherein said opening of said first panel is an arcuate opening, and wherein said tab is received in said opening while a remainder of said first panel remains positioned outside said opening such that said tab is slidable in said opening when said stand is pivoted relative to said folder body.

13. The folder of claim 12 wherein said second panel of the folder body further includes a second opening, wherein the second opening is arcuate, wherein said stand further includes a second tab received in said second opening while a remainder of said second panel remains positioned outside said second opening such that said second tab is slidable in said second opening when said stand is pivoted relative to said folder body, and wherein at least another part of said protective component covers said second opening of said second panel, and wherein said protective component is directly secured to said second panel.

14. The folder of claim 1 wherein said stand is pivotable between said support position and a collapsed position, and is separately directly pivotally coupled to each of said first and second panels.

15. The folder of claim 1 wherein said stand, including said tab, is entirely made of a single, unitary piece of material.

16. The folder of claim 1 wherein said stand includes a first portion and a second portion directly pivotally coupled to each other along a single fold line about which each of said portions are directly pivotable.

17. The folder of claim 1 wherein said first and second panels are each flat and planar and lack any fold lines.

18. The folder of claim 1 wherein said stand is pivotally coupled to each panel by a rivet defining the associated pivot point.

19. The folder of claim 1 wherein the protective component includes an extension portion that covers at least a portion of the first side of the folder body.

20. The folder of claim 1 wherein the first panel includes a supplemental opening and the stand includes a supplemental tab, wherein the supplemental tab is received in the supplemental opening, and wherein said opening and said supplemental opening are arcuate such that said tab and said supplemental tab are positioned on an opposite side of the first panel relative to a remainder of said stand to guide pivotal movement of said stand.

21. The folder of claim 1 wherein said at least a portion of said protective component entirely covers a portion of said tab extending through said opening.

22. The folder of claim 1 wherein said protective component is directly coupled to said first panel and wherein said protective component entirely covers said opening regardless of whether said folder body is in an open or a closed position.

23. The folder of claim 22 wherein said protective component is directly coupled to said first panel by welds about a perimeter of said protective component.

24. The folder of claim 1 wherein the first and second panel are both rigid and rectangular in top view, and lack any internal fold lines.

25. The folder of claim 1 wherein the first panel and the second panel are flat and rectangular in top view and have the same size and shape.

26. A folder comprising:

a folder body including a first panel and a second panel pivotally coupled to said first panel, wherein said folder body is movable between an open position wherein said first and second panels are parallel and non-overlapping and a closed position wherein said first and second panels are parallel and overlapping; and a stand pivotally coupled to said first and second panels, said stand being movable to a support position wherein said stand is configured to be able to support said folder body in a propped position, wherein said stand is pivotally coupled to each panel at an associated pivot point, wherein said stand is pivotable relative to said folder body to the support position when said folder body is and remains in said closed position.

27. A folder comprising:

a folder body including a first panel and a second panel pivotally coupled to said first panel along a fold line, wherein said folder body is movable between an open position wherein said first and second panels are parallel and non-overlapping and a closed position wherein said first and second panels are parallel and overlapping; and a stand coupled to said first and second panels, said stand being movable between a support position wherein said stand is at least partially spaced away from said folder body and configured to support said folder body in a propped position, and a collapsed position wherein said stand closely conforms to said folder body, wherein said stand includes a first portion and a second portion directly pivotally coupled to each other along a stand fold line about which each of said portions are directly pivotable, wherein said first and second portions are configured to be positioned on an outer surface of said folder body when said folder body is in said closed position, and wherein said stand fold line is parallel with said fold line of said folder body.

28. A folder comprising:

a folder body including a first panel and a second panel pivotally coupled to said first panel, wherein said folder body is movable between an open position wherein said first and second panels are parallel and non-overlapping and a closed position wherein said first and second panels are parallel and overlapping; and a stand pivotally coupled to said first and second panels, said stand being movable to a support position wherein said stand is configured to support said folder body in a propped position, wherein said stand is pivotally coupled to each panel at an associated pivot point thereof defining a pivot axis positioned within and extending perpendicular to each panel when said folder body is in said open position, wherein each associated pivot point is spaced away from an outer perimeter of the respective panel.

29. The folder of claim 26 wherein said stand is pivotable relative to said folder body to a collapsed position wherein said stand conforms against said folder, and wherein said stand does not closely conform against said folder when said stand is in said support position.

30. The folder of claim 26 wherein when said folder body is in said closed position said first and second panels overlap in a thickness direction of said folder body extending perpendicular to said first and second panels.

31. The folder of claim 27 wherein said first panel is a same size and shape as said second panel, and wherein said first portion is a same size and shape as said second portion.

* * * * *